United States Patent [19]

Redmon et al.

[11] Patent Number: 4,585,283

[45] Date of Patent: Apr. 29, 1986

[54] MULTI-BAG LAUNDRY HAMPER

[75] Inventors: C. Peter Redmon; Samuel C. Redmon, both of Peru, Ind.; Henry P. Glass, Northfield, Ill.

[73] Assignee: W. C. Redmon Company, Peru, Ind.

[21] Appl. No.: 645,114

[22] Filed: Aug. 28, 1984

[51] Int. Cl.[4] ..... A47B 46/00

[52] U.S. Cl. ..... 312/250; 312/257 SK; 312/258

[58] Field of Search ..... 312/257 SK, 258, 250, 312/211, 257 R, 257 SM; 248/95, 97, DIG. 7

[56] References Cited

U.S. PATENT DOCUMENTS

| | | | |
|---|---|---|---|
| 841,926 | 1/1907 | Brown | 248/97 |
| 851,749 | 4/1907 | Henke | 248/97 |
| 892,187 | 6/1908 | Schriefer | 312/257 R |
| 3,458,242 | 7/1969 | Williams | 312/258 |
| 3,995,924 | 12/1976 | Jones | 248/95 |

OTHER PUBLICATIONS

"W. C. Redmon Company Product Catalog", pp. 1–20, published by W. C. Redmon Company, Peru, Ind., 1984.

*Primary Examiner*—William E. Lyddane

*Assistant Examiner*—Joseph Falk

*Attorney, Agent, or Firm*—Dressler, Goldsmith, Shore, Sutker & Milnamow, Ltd.

[57] ABSTRACT

A laundry hamper arrangement is disclosed which has been particularly configured to include a plurality of individually removable inner hamper bags. The arrangement includes a box-like hamper having spaced front and rear panel members, and laterally spaced side panel members extending therebetween. Notably, the hamper includes generally rectangular upper and lower frames which are respectively positionable in contiguous relationship with the upper and lower edges of the hamper panel members, and which in the preferred form are of identical configuration to facilitate economical manufacture. A plurality of substantially non-rigid hamper bags are removably positionable within the box-like hamper, with the upper frame thereof including upturned supporting lips for removably supporting the hamper bags. In one embodiment of the invention, means are provided for slidably joining the side panel members to extruded corner members affixed to the front and rear panel members. In an alternate embodiment, hinged corner assemblies are provided to permit the hamper panel members to be relatively moved to a "knocked down" or collapsed configuration.

11 Claims, 9 Drawing Figures

FIG. 3
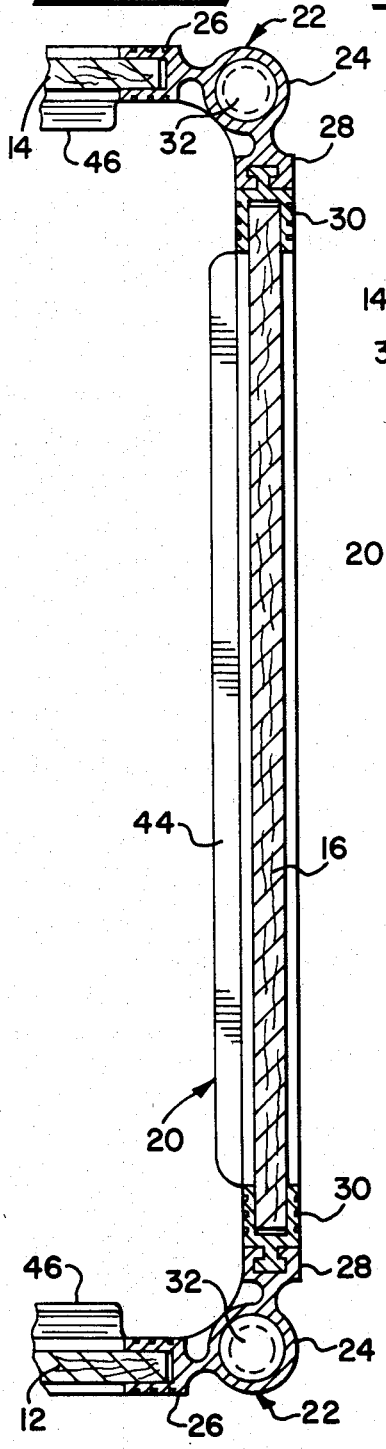
FIG. 4
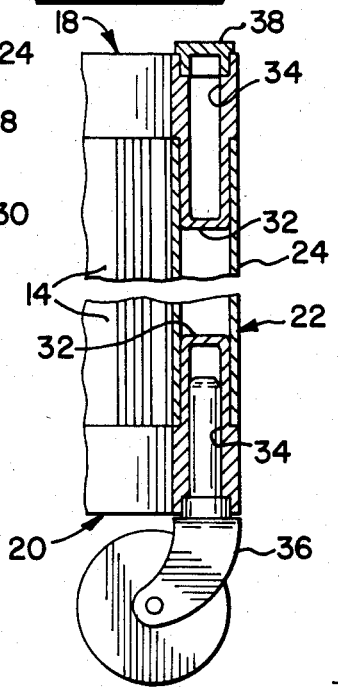
FIG. 5
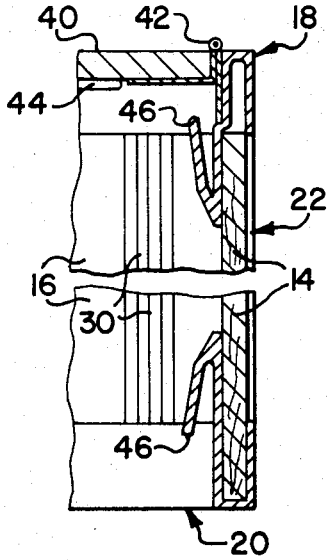
FIG. 6
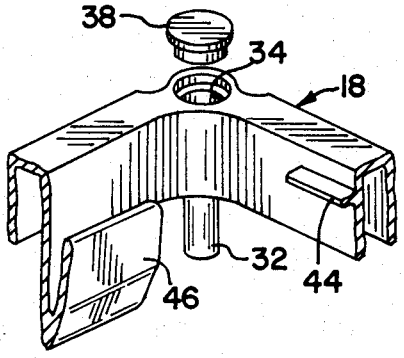
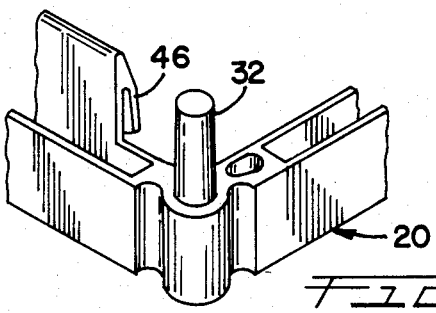
FIG. 7

MULTI-BAG LAUNDRY HAMPER

TECHNICAL FIELD

The present invention relates generally to laundry or clothes hamper constructions, and more particularly to a laundry hamper arrangement which has been particularly configured to provide a plurality of individually removable hamper bags, and which as been further configured for economical manufacture, and convenient shipment and assembly.

BACKGROUND OF THE INVENTION

Laundry or clothes hampers are intended to provide convenient storage of soiled laundry prior to washing. Such hampers may be fabricated from wood, plastic, cloth, or woven wicker products (or combinations thereof), and are ordinarily placed in the bedroom or bathroom of a home so that laundry can be neatly collected without unsightly clutter. Such hampers are typically available in a wide variety of colors and styles, and thus can be coordinated with furniture and the like for enhancing decor.

While hampers of the above description have proven to be quite popular for use in the home, the constructions have typically been such as to define only a single box-like enclosure for receiving laundry. While such constructions of course provide the desired neat and convenient storage of laundry, it will be appreciated that subsequent sorting of the laundry is ordinarily required so that articles are appropriately grouped for washing. For example, it is not uncommon to sort laundry into groups of "lights", "darks", and "permanent press" or delicate fabrics. While such sorting of laundry is by no means difficult, it can be time-consuming and add to the chore of washing.

Another disadvantage associated with many hamper constructions heretofore known relates to the general size or bulk of such arrangements. Naturally, a hamper is preferably sized for efficiently holding a reasonable quantity of soiled laundry, but the box-like configuration of such hampers detracts from their efficient storage and shipment. Although hamper constructions are known comprising wooden and fabric elements which are assembled by a consumer for use, hampers made of woven wicker or the like ordinarily cannot be shipped and sold in such a "knocked down" or disassembled condition.

With the above considerations in mind, the laundry hamper arrangement of the present invention has been specifically configured to include a plurality of individually removable inner hamper bags, and has further been specifically configured to promote economical manufacture, compact storage and shipment, and convenient assembly by consumers.

SUMMARY OF THE INVENTION

The laundry hamper construction of the present invention particularly facilitates convenient storage of soiled laundry by including at least one, and preferably a plurality such as three, of individually removable hamper bags which are removably supported by a box-like hamper. By providing a plurality of inner hamper bags in accordance with the preferred embodiment, the various pieces of laundry placed in the hamper can be "sorted" as they are placed into the construction merely by placing the laundry in the appropriate one of the inner hamper bags. Not only does the construction thus lend desirable convenience to the sorting and grouping of clothes and other articles for washing, the arrangement has further been configured for efficient "knocked down" storage and shipment. Further features of the construction promote very convenient assembly by consumers, with the construction further including a number of features which facilitate economical manufacture, thus permitting the construction to be competitively and affordably priced.

The laundry hamper arrangement of the present invention first includes a box-like hamper including vertical front and rear panel members positionable in spaced apart relation, and a pair of laterally spaced, vertical side panel members positionable to extend between respective opposite ends of the front and rear panel members. In the preferred form, the hamper is preferably provided with a hinged upper cover member, and has an open bottom.

The present construction further includes at least one, and preferably a plurality, of hamper bags, which are individually removably positionable within the box-like hamper. To this end, the hamper includes an arrangement of upturned supporting lips for removably supporting the one or more hamper bags. Notably, each hamper bag is of substantially non-rigid construction, and includes a drawstring about the opening thereof to permit closing after removal of the bag from within the hamper.

A number of features of the construction of the box-like hamper facilitate its manufacture and assembly. In the preferred embodiment, the hamper includes a generally rectangular upper frame which is positionable in contiguous relation with the upper edge portions of the front, rear, and side panel members. The hamper further includes a generally rectangular lower frame which is similarly positionable in contiguous relation with the lower edges of the panel members. Significantly, manufacture is facilitated by providing the upper and lower frames with identical, one-piece molded configurations.

The box-like hamper further includes first and second pairs of corner members which are respectively positionable at the junctions of the front and side panel members, and at the junctions of the rear and side panel members for joining the panel members together. Economical manufacture is further facilitated by providing the corner members with identical extruded configurations, with each including a central tubular portion. By this arrangement, a retention pin provided at each of the corners of the rectangular upper and lower frames can be received within a respective one of the corner members.

To facilitate convenient assembly, one embodiment of the present hamper arrangement includes means for slidably joining the side panel members to the corner members. By this construction, the four corner members of the hamper can be joined (such as by adhesive) to the front and rear panel members during manufacture, with final assembly of the hamper by consumers conveniently effected by merely sliding the side panel members into association with the corner members. In an alternate embodiment, each corner member is configured to comprise a hinge assembly such that the front, rear, and side panel members are relatively movable from a "knocked down" or collapsed configuration for efficient storage and shipment, to an opened or expanded condition which generally defines the box-like configuration of the hamper. With either embodiment, the upper and lower frames of the hamper can be conveniently fitted to the panel members after the panel members have been relatively positioned in their box-like configuration.

Numerous other features and advantages of the present invention will become readily apparent from the following detailed description, the accompanying drawings, and the appended claims.

BRIEF DESCRIPTION OF THE DRAWINGS

FIG. 3 is a partial cross-sectional view taken generally along lines 3—3 of FIG. 1;

FIG. 4 is a partial cross-sectional view taken generally along lines 4—4 of FIG. 1;

FIG. 5 is a partial cross-sectional view taken generally along lines 5—5 of FIG. 1;

FIGS. 6 and 7 are partial perspective views of corner portions of upper and lower frames of the present hamper arrangement;

DETAILED DESCRIPTION

Figure 1:
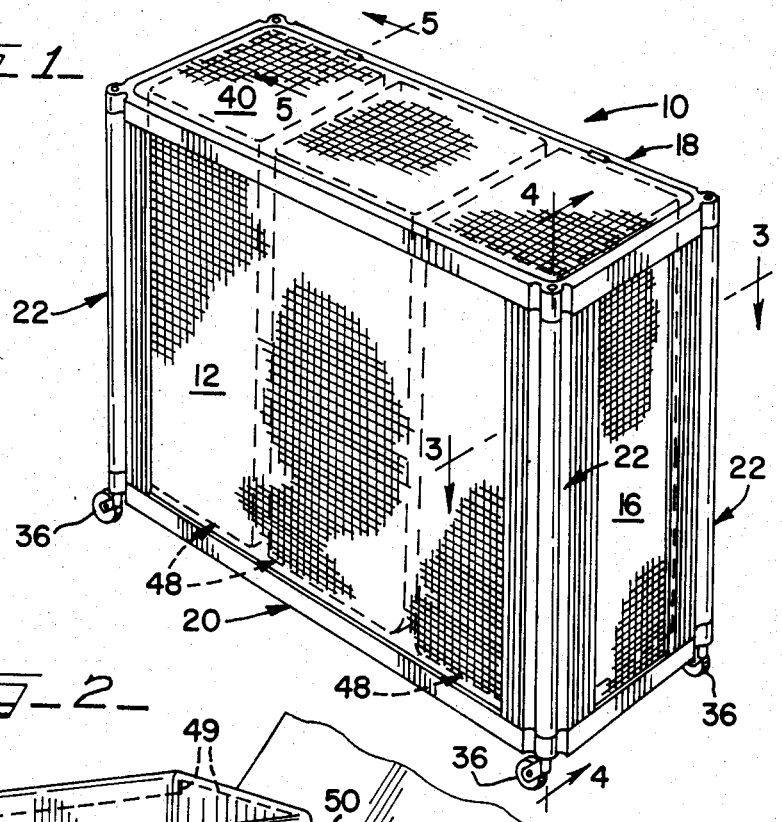
FIG. 1 is a front perspective view of a multiple-bag laundry hamper arrangement embodying the principles of the present invention.

While tne present invention is susceptible of embodiment in various forms, there is shown in the drawings and will hereinafter be described first and second embodiments of the invention, with the understanding that the present disclosure is to be considered as an exemplification of the invention, and is not intended to limit the invention to the specific embodiments illustrated.

Figure 2:
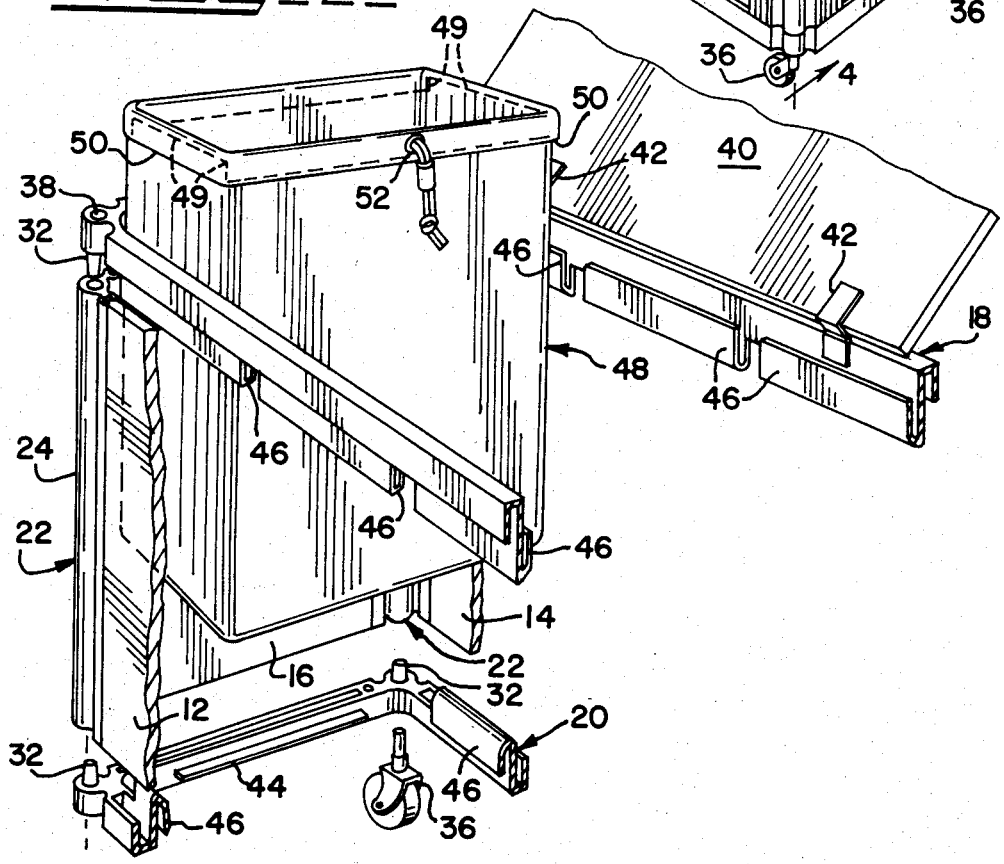
FIG. 2 is a partial, exploded perspective view of the hamper arrangement shown in FIG. 1, with various elements of the construction shown partially cut-away for clarity.

With reference first to FIGS. 1 to 3, therein is illustrated a multiple-bag laundry hamper arrangement embodying the principles of the present invention. While it will be apparent from the following description that many of the features of the present construction can desirably be incorporated in an arrangement having only a single removable inner hamper bag, it is presently preferred that the construction include a plurality of inner bags, such as three, thus facilitating convenient sorting of laundry as it is placed in the hamper construction.

The present arrangement first includes an outer box-like hamper 10 which has been particularly configured for economical manufacture and convenient assembly. Hamper 10 includes a substantially planar front panel member 12, which is positionable in spaced apart relation to a substantially planar rear panel member 14. Hamper 10 further includes a pair of laterally spaced, substantially planar, vertical side panel members 16 which are positionable to extend between respective opposite ends of the front and rear panel members 12 and 14. The front, rear, and side panel members can economically be formed from a number of suitable materials such as particle board or Masonite TM, and are illustrated in FIG. 1 as having a decorative woven fabric-like material applied thereto.

The box-like hamper 10 further includes a generally rectangular upper frame 18 which is positionable in contiguous relation with the upper edges of front and rear panel members 12 and 14, and side panel members 16. The upper frame 18 is formed with a channel-like configuration such that the upper edges of panel members 12, 14 and 16 can be received therein. As will be further described, upper frame 18 can very conveniently be fitted to the other components of the hamper to achieve the desired structural integrity for the construction.

Hamper 10 further includes a generally rectangular lower frame 20 which is positionable in contiguous relation with the lower edges of panel members 12, 14, and 16. Lower frame 20 also has a channel-like configuration such that the edge portions of the panel members are received therein.

Significantly, it is to be noted that upper frame 18 and lower frame 20 are illustrated as being of identical, relatively inverted configurations. Economy of manufacture is greatly facilitated by this feature of the invention, since each of the upper and lower frames 18 and 20 preferably comprises a one-piece molding. Use of identically configured upper and lower frames permits manufacture of but a single type of frame for the box-like hamper 10.

In further keeping with the goal of economy of manufacture, hamper 10 includes first and second pairs of corner members 22 which are respectively provided at the junctions of front panel member 12 with side panel members 16, and the juhctions of rear panel member 14 with the side panel members. As will be observed, each of the four corner members 22 is of an identical, preferably extruded configuration.

With particular reference to FIG. 3, the preferably extruded configuration of each corner member 22 has been selected to promote convenient assembly with the associated hamper panel members. Each corner member 22 includes a central tubular portion 24 from which extend a first channel portion 26 and a second channel portion 28 disposed generally at a right angle to each other.

As best shown in FIG. 3, first channel portion 26 is configured to receive the lateral edges of front and rear panel members 12 and 14. In distinction, second channel portion 28 is provided with a configuration to slidably interlock and cooperate with a respective channel member 30 fitted to an edge of one of the side panel members 16. By this construction, the corner members 22 can be affixed to front and rear panel members 12 and 14 during manufacture such as by adhesive or the like. A suitable adhesive can likewise be employed for affixing a pair of channel members 30 to the opposite edges of each side panel member 16 during manufacture. This permits the hamper 10 to be shipped in a "knocked down" or disassembled fashion, with the side panel members 16 conveniently joined to the front and rear panel members 12 and 14 merely by sliding channel members 30 into the second channel portion 28 of eacn corner member 22. Upper and lower frames 18 and 20 can then be positioned to respectively receive the upper and lower edges of panel members 12, 14, and 16.

It will be further noted that the configuration of each corner member 22 has been provided so as to cooperate with the preferably identically configured upper and lower frames 18 and 20. Each of the upper and lower frames 18 and 20 is provided with an integral retention pin 32 at each of its corners, with the molded configuration of each pin 32 providing a corresponding socket 34. The retention pins 32 of the upper and lower frames 18 and 20 are received within the central tubular portions 24 of corner members 22 during assembly of hamper 10, thus providing desired cooperation between the various components of the hamper for convenient assembly and desired rigidity. Notably, the provision of sockets 34 in the lower frame 20 permits convenient fitment of caster wheels 36, thus permitting the entire hamper arrangement to easily be moved from one location to another. Caps 38 are preferably fitted to sockets 34 of the upper frame 18 to provide the overall construction with a neat and aesthetically pleasing appearance.

The overall appearance and convenient use of the present hamper arrangement are further enhanced by the provision of hinged cover member 40 for the hamper 10. Cover member 40 can be fabricated of materials like those of the panel members of the hamper, and is preferably hingedly joined to upper frame 18 by hinges 42 for movement between opened and closed positions. A pair of lips 44 are respectively provided on the laterally opposite portions of upper frame 18 for supporting cover member 40 in its closed position (with these lips 44 likewise provided on the preferably identically configured lower frame 20).

In keeping with the preferred form of the present invention, the box-like hamper 10 includes means for removably supporting a plurality of hamper bags (such as three bags as shown in phantom line in FIG. 1) within the hamper 10. To this end, upper frame 18 includes respective pairs of upturned support lips 46 on its forward and rearward portions, with each pair of support lips configured to removably support a hanging hamper bag 48 specifically configured for cooperation therewith. As best shown in FIG. 2, which illustrates one of hamper bags 48, each hamper bag is preferably of a substantially non-rigid construction (such as comprising suitable fabric or the like), and has an overturned upper edge portion which is stitched or otherwise secured at 49 to provide a pair of opposite, downwardly open recess-like pockets or openings at 50. As will be appreciated, each of the recess-like openings at 50 is configured to receive in male/female relationship a respective one of the support lips 46 of upper frame 18, thus permitting the hamper bag to be very conveniently positioned and hung within the hamper 10. The effective length of each support lip 46 and the length of each recess-like opening 50 are preferably selected selected to coincide such that the support lips 46 support the bag 48 in a fully opened and substantially taut condition within hamper 10.

In the preferred embodiment, each hamper bag 48 has an upper opening about which a drawstring 52 extends to permit closing of the bag opening after removal from within the hamper. As will be recognized, each of the hamper bags 48 is very conveniently individually positionable within the hamper 10, thus permitting any selected one or ones of the bags to be removed as desired. As will be recognized, the stitching or other securement at 49 acts to confine and otherwise retain and maintain drawstring 52 in position adjacent to and about the upper opening of hamper bag 48 (for permitting bag closing after removal from the hamper), while at the same time providing the recess-like openings at 50 for cooperation with support lips 46 for maintaining the upper bag opening in a substantially fully opened condition when the hamper bag is supported within the hamper.

Figure 8:
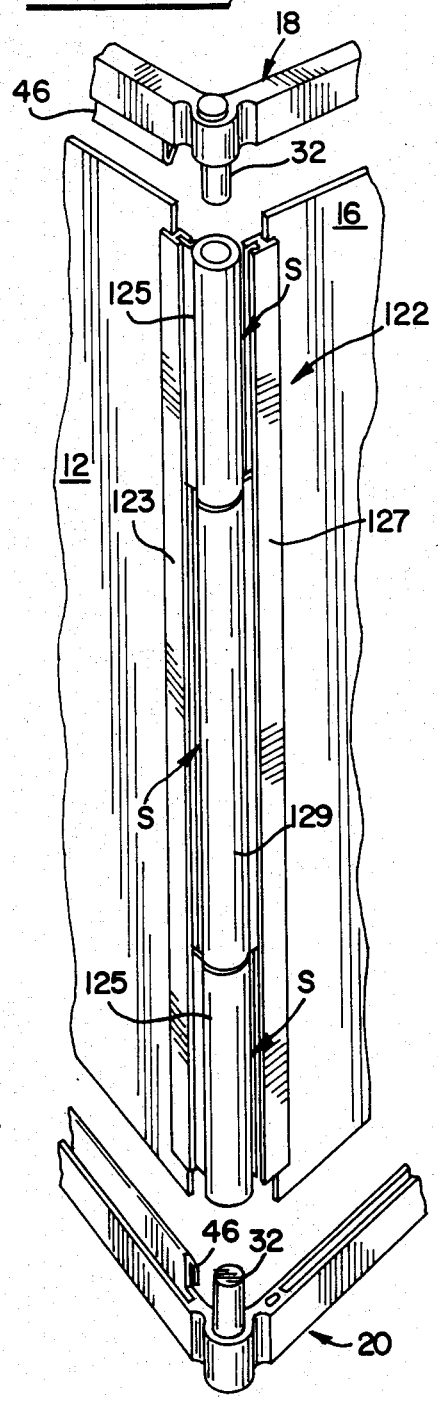
FIG. 8 is a partial exploded perspective view illustrating an alternate corner construction for the present arrangement.
Figure 9:
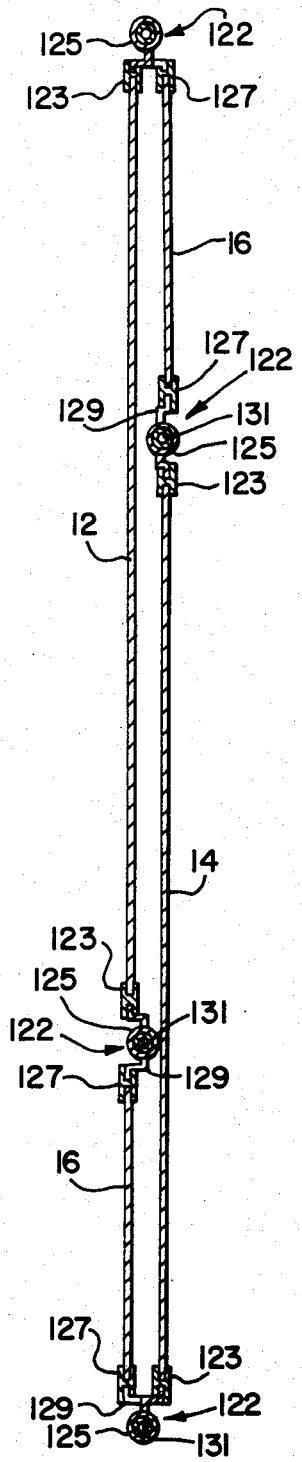
FIG. 9 is a a diagramatic view illustrating use the corner construction snown in FIG. 8 to permit "knock down" or collapsing of the present construction for shipment or storage.

Referring now to FIGS. 8 and 9, therein is illustrated an alternate corner construction for the hamper 10 of the present invention. While the previously described construction is configured to permit convenient "knock down" and assembly of the hamper 10 by providing sliding cooperation between side panel members 16 and corner members 22, the corner construction of FIGS. 8 and 9 is such that the panel members of the hamper can be relatively moved from a generally flat collapsed configuration (for shipment or storage) to a generally opened or expanded configuration which defines the generally box-like configuration of the hamper.

To this end, FIG. 8 illustrates a hinged corner assembly 122 which can be provided at each of the junctions of front and rear panel members 12 and 14 with side panel members 16. While a hinged corner construction including integrally formed "living hinges" or the like can be desirable depending upon the size of the resultant hamper arrangement, the illustrated corner assembly 122 includes cooperating hinge members respectively joined to the panel members of the hamper. Specifically, each corner assembly 122 includes a channel portion 123 adapted to be affixed to a respective one of front and rear panel members 12 and 14. A pair of generally tubular portions 125 are in turn configured for a cooperating fit with channel portion 123, such as in the form of the illustrated "dovetail" connection.

The corner assembly 122 further includes a channel portion 127 affixed to a respective one of side panel members 16. A generally tubular portion 129 is in turn connected to the channel portion 127. As will be appreciated, the channel portion 123 together with tubular portions 125, and the channel portion 127 together with the tubular portion 129, together define a pair of cooperating hinge members for the corner assembly 122. Notably, economical manufacture of this construction is facilitated in that channel portions 123 and 127 can be of an identical extruded configuration, with tubular portions 125 and 129 likewise being of identical extruded configurations.

The hinged corner assembly 122 turther includes a cylindrical hinge pin 131 (FIG. 9) which extends through the aligned tubular portions 125 and 129. The tubular portions are thus joined together for relative hinging movement, thus permitting the front, rear, and side panel members 12, 14, and 16 to be relatively positioned in a collapsed condition as illustrated in FIG. 9. As will be recognized, this alternate corner construction for the hamper 10 desirably provides tubular portions for receiving and cooperating with retention pins 32 of upper and lower frames 18 and 20. Further, corner assembly 122 promotes good ventilation within the hamper construction by the provision of slots at S between the channel portions 123 and 127, and the tubular portions of the corner assembly joined to the other of the channel portions.

Thus, a laundry hamper arrangement is disclosed which permits individual removable support of a plurality of inner hamper bags, and which has been configured for economical manufacture and ease of assembly. From the foregoing, it will be observed that numerous modifications and variations can be effected without departing from the true spirit and scope of the novel concept of the present invention. It will be understood that no limitation with respect to the specific embodiments illustrated herein is intended or should be inferred. The disclosure is intended to cover by the appended claims all such modifications as fall within the scope of the claims.

What is claimed is:

1. A multiple-bag hamper arrangement, comprising:

a box-like hamper including vertical front and rear panel members positionable in spaced apart relation, and a pair of vertical side panel members positionable to extend between respective opposite ends of said front and rear panel members; and a plurality of hamper bags individually removably positionable within said hamper, said hamper including means for removably supporting each said hamper bag;

said hamper including a generally rectangular upper frame positionable in contiguous relation with upper edge portions of said front, rear, and side panel members, said hamper further including a generally rectangular lower frame positionable in contiguous relation with lower edge portions of said front, rear, and side panel members, said upper and lower frames being of an identical configuration to each other, said hamper including first and second pairs of corner members respectively positionable at junctions of said front and side panel members, and at junctions of said rear and side panel members, for joining said panel members together, each said corner member defining a pin-receiving opening at the upper ends and at the lower ends thereof, each of said generally rectangular upper and lower frames including an integral pin portion at each of the four corners thereof, said pin portions being respectively positionable in the pin-receiving openings of said first and second pairs of said corner members when said upper and lower frames are positioned in contiguous relation with the edge portions of said front, rear, and side panel members.

2. A mutiple-bag hamper arrangement in accordance with claim 1, wherein each said hamper bag is of substantially non-rigid construction, and includes drawstring means about an opening thereof to permit closing of said opening after removal of said bag from within said hamper.

3. A mutiple-bag hamper arrangement in accordance with claim 1, wherein each of said corner members comprises hinge means for providing relative hinging movement of the adjacent ones of said front, rear, and side panel members associated with that one of the corners members, whereby said front, rear, and side panel members are relatively movable between an open configuration which generally defines said box-like configuration of said hamper, and a generally flat collapsed configuration.

4. A multiple-bag hamper arrangement in accordance with claim 1, including means for slidably joining said side panel members to said corner members.

5. A laundry hamper arrangement, comprising:

a box-like hamper including vertical front and rear panel members positionable in spaced apart relation, and a pair of vertical side panel members positionable to extend between respective opposite ends of said front and rear panel members, said hamper further comprising a pair of generally rectangular upper and lower frames each having a channel-like configuration for receiving respective upper and lower edge portions of said front, rear, and side panel members; and at least one hamper bag removably positionable within said hamper, said upper frame including means for removably supporting said hamper bag, said hamper including first and second pairs of corner members respectively positionable at junctions of said front and side panel members, and at junctions of said rear and side panel members for joining said panel members together, each said upper and lower frame including pin means respectively positionable within pin-receiving openings provided at opposite ends of each of said corner members, said hamper bag defining an upper opening, and including downwardly open, recess-like means at an upper edge portion thereof, said supporting means for removably supporting said hamper bag comprising upturned support lip means formed integrally with said upper frame adapted to be received in said recess-like means of said hamper bag for cooperation therewith to maintain said upper bag opening in a substantially fully opened condition when said hamper bag is supported within said hamper, said hamper bag including drawstring means for closing said upper bag opening when said bag is removed from said hamper.

6. A laundry hamper arrangement in accordance with claim 5, wherein said upper and lower frames are of identical configuration.

7. A laundry hamper arrangement in accordance with claim 5, including means for slidably joining said side panel members to said corner members.

8. A laundry hamper arrangement in accordance with claim 5, wherein said hamper includes a cover member hingedly mounted for movement on said upper frame.

9. A laundry hamper arrangement in accordance with claim 8, wherein each said corner member comprises hinge means for providing relative hinging movement of adjacent ones of said front, rear, and side panel members associated with that one of the corner members, whereby said front, rear, and side panel members are relatively movable between an open configuration which generally defines said box-like configuration of said hamper, and a generally flat collapsed configuration.

10. A laundry hamper arrangement in accordance with claim 6, wherein each said corner member comprises an identically configured extruded member.

11. A laundry hamper arrangement, comprising:

a box-like hamper including vertical front and rear panel members positionable in spaced apart relation, and a pair of vertical side panel members positionable to extend between respective opposite ends of said front and rear panel members, said hamper further comprising a pair of generally rectangular upper and lower frames configured to receive respective upper and lower edge portions of said front, rear, and side panel members; and at least one hamper bag removably positionable within said hamper, said upper frame including means for removably supporting said hamper bag, said hamper including first and second pairs of corner members respectively positionable at junctions of said front and side panel members, and at junctions of said rear and side panel members for joining said panel members together, each said upper and lower frame including pin means respectively positionable within a pin-receiving opening defined by each of said corner members, said pin means of said lower frame extending upwardly and defining internal, downwardly open socket means for receiving an upwardly extending portion of an associated caster wheel.

* * * * *